US010744661B2

(12) United States Patent
Griffin et al.

(10) Patent No.: US 10,744,661 B2
(45) **Date of Patent: *Aug. 18, 2020**

(54) SHAVING SYSTEMS

(71) Applicant: ShaveLogic, Inc., Dallas, TX (US)

(72) Inventors: John W. Griffin, Moultonboro, NH (US); Craig A. Provost, Newport Beach, CA (US); William E. Tucker, Plymouth, MA (US)

(73) Assignee: ShaveLogic, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/405,345

(22) Filed: May 7, 2019

(65) Prior Publication Data

US 2019/0263010 A1 Aug. 29, 2019

Related U.S. Application Data

(63) Continuation of application No. 15/455,507, filed on Mar. 10, 2017, now Pat. No. 10,328,587, which is a continuation of application No. 14/661,048, filed on Mar. 18, 2015, now Pat. No. 9,630,331, which is a continuation of application No. PCT/US2013/052107, filed on Jul. 25, 2013.

(60) Provisional application No. 61/706,961, filed on Sep. 28, 2012.

(51) Int. Cl.

| | |
|---|---|
| ***B26B 21/22*** | (2006.01) |
| ***B26B 21/40*** | (2006.01) |
| ***B26B 21/52*** | (2006.01) |

(52) U.S. Cl.
CPC ..... *B26B 21/225* (2013.01); *B26B 21/4081* (2013.01); *B26B 21/521* (2013.01)

(58) Field of Classification Search
CPC .. B26B 21/225; B26B 21/521; B26B 21/4081
See application file for complete search history.

(56) References Cited

U.S. PATENT DOCUMENTS

| | | | |
|---|---|---|---|
| 996,879 | A | 7/1911 | Odell |
| 1,015,575 | A | 1/1912 | Meyer |
| 1,074,615 | A | 10/1913 | Folmer |
| 1,498,155 | A | 6/1924 | Dorr |

(Continued)

FOREIGN PATENT DOCUMENTS

| | | |
|---|---|---|
| EP | 0951971 A1 | 10/1999 |
| EP | 1245351 | 10/2002 |

(Continued)

OTHER PUBLICATIONS

European Patent Application No. 19192461.2 Extended European Search Report dated Dec. 4, 2019, 8 pages.

(Continued)

*Primary Examiner* — Hwei-Siu C Payer
(74) *Attorney, Agent, or Firm* — Leber IP Law; Celia H. Leber

(57) ABSTRACT

Replaceable shaving assemblies are disclosed that include a blade unit, an interface element configured to removeably connect the blade unit to a handle, on which the blade unit is pivotably mounted, and a return element disposed on the interface element. Shaving systems including such shaving assemblies are also disclosed, as are methods of using such shaving systems.

15 Claims, 15 Drawing Sheets

(56) References Cited

U.S. PATENT DOCUMENTS 1,822,766 A 9/1931 Duffy
2,406,983 A 9/1946 Anderson
2,406,985 A 9/1946 Anderson
3,311,975 A 4/1967 Longuyon
3,593,416 A 7/1971 Edson
3,709,517 A 1/1973 Wossner
3,768,348 A 10/1973 Braun et al.
3,938,247 A 2/1976 Carbonell et al.
4,094,063 A 6/1978 Trotta
4,198,746 A 4/1980 Trotta
4,347,663 A 9/1982 Ullmo
4,403,414 A 9/1983 Kiraly et al.
4,475,286 A 10/1984 Saito
4,774,765 A 10/1988 Ferraro
4,785,534 A 11/1988 Lazarchik
4,834,760 A 5/1989 Richter, Jr.
4,838,564 A 6/1989 Jarvis
4,850,518 A 7/1989 Salmon et al.
4,970,784 A 11/1990 Althaus
5,029,391 A 7/1991 Althaus et al.
5,074,042 A 12/1991 Althaus et al.
5,168,628 A 12/1992 Mock et al.
5,219,468 A 6/1993 Olson
5,369,885 A 12/1994 Ferraro
5,402,574 A 4/1995 Milner
5,466,901 A 11/1995 Mochizuki
5,533,263 A 7/1996 Gilder
5,551,153 A 9/1996 Simms
5,551,717 A 9/1996 De Courcey
5,560,106 A 10/1996 Armbruster et al.
5,645,603 A 7/1997 Peters
5,661,907 A 9/1997 Apprille, Jr.
5,669,139 A 9/1997 Oldroyd et al.
5,678,316 A 10/1997 Althaus et al.
5,771,591 A 6/1998 Armbruster et al.
5,794,342 A 8/1998 Davey
5,813,293 A 9/1998 Apprille et al.
5,855,071 A 1/1999 Apprille, Jr. et al.
5,890,296 A 4/1999 Metcalf et al.
6,014,918 A 1/2000 Orloff
6,112,412 A 9/2000 Richard
6,122,826 A 9/2000 Coffin et al.
6,138,361 A 10/2000 Richard et al.
6,145,201 A 11/2000 Andrews
6,161,287 A 12/2000 Swanson et al.
6,182,366 B1 2/2001 Richard
6,216,345 B1 4/2001 Andrews
6,223,442 B1 5/2001 Pina
6,311,400 B1 11/2001 Hawes
6,357,118 B1 3/2002 Eichhorn et al.
6,502,318 B1 1/2003 Gilder
6,557,265 B2 5/2003 Coffin
6,560,881 B2 5/2003 Coffin
6,612,040 B2 9/2003 Gilder
6,615,498 B1 9/2003 King et al.
6,637,113 B2 10/2003 Ikuta et al.
6,655,028 B2 12/2003 Coffin
6,772,523 B1 8/2004 Richard et al.
6,807,739 B2 10/2004 Follo
6,851,190 B2 2/2005 Guimont et al.
6,854,188 B1 2/2005 Wonderley
6,880,253 B1 4/2005 Gyllerstrom
6,973,730 B2 12/2005 Tomassetti et al.
6,990,740 B2 1/2006 Follo et al.
6,996,908 B2 2/2006 Orloff et al.
6,997,446 B2 2/2006 Hall et al.
7,028,405 B2 4/2006 Paas et al.
7,086,160 B2 8/2006 Coffin et al.
7,100,284 B2 9/2006 King
7,103,976 B2 9/2006 Pennella
7,152,512 B1 12/2006 Prochaska
7,200,942 B2 4/2007 Richard
7,266,895 B2 9/2007 Pennella et al.
7,370,419 B2 5/2008 Coffin et al.
7,441,336 B2 10/2008 Hawes
7,461,458 B2 12/2008 Peyser et al.
7,510,345 B2 3/2009 Kosh et al.
7,526,869 B2 5/2009 Blatter et al.
7,574,809 B2 8/2009 Follo et al.
7,669,511 B2 3/2010 King
7,784,504 B2 8/2010 Freed et al.
7,797,834 B2 9/2010 Steunenberg et al.
7,802,368 B2 9/2010 Coffin et al.
7,877,879 B2 2/2011 Nakasuka
7,913,393 B2 3/2011 Royle
7,971,363 B2 7/2011 Nakasuka
8,033,023 B2 10/2011 Johnson et al.
8,079,147 B2 12/2011 Wonderley
8,096,054 B2 1/2012 Denkert et al.
8,166,661 B2 5/2012 King
8,205,343 B2 6/2012 Winter et al.
8,205,344 B2 6/2012 Stevens
8,234,761 B2 8/2012 Gompert et al.
8,273,205 B2 9/2012 Murgida
8,307,552 B1 11/2012 Drouillard
8,359,751 B2 1/2013 Efthimiadis et al.
8,479,398 B2 7/2013 Coresh
8,484,852 B2 7/2013 King
8,499,459 B2 8/2013 Efthimiadis et al.
8,590,162 B2 11/2013 Park et al.
8,640,342 B2 2/2014 Murgida
8,671,577 B2 3/2014 Brown
8,732,955 B2 5/2014 Howell et al.
8,746,223 B2 6/2014 Jones
8,769,825 B2 7/2014 Howell et al.
8,789,282 B2 7/2014 Wilson et al.
8,793,880 B2 8/2014 Taub et al.
8,844,145 B2 9/2014 Psimadas et al.
8,869,781 B2 10/2014 Jones
8,967,130 B2 3/2015 Victor et al.
9,283,685 B2 3/2016 Griffin et al.
9,469,038 B2 10/2016 Iaccarino et al.
9,475,202 B2 10/2016 Griffin et al.
9,486,930 B2 11/2016 Provost et al.
9,623,575 B2 4/2017 Griffin et al.
9,630,331 B2 4/2017 Griffin et al.
9,676,108 B2 6/2017 Beugels et al.
9,902,077 B2 2/2018 Park et al.
10,328,587 B2 * 6/2019 Griffin ..... B26B 21/4081
2003/0046819 A1 3/2003 Ferraro et al.
2004/0177519 A1 9/2004 Tomassetti et al.
2005/0039338 A1 2/2005 King et al.
2005/0278954 A1 12/2005 Orloff et al.
2006/0080837 A1 4/2006 Johnson et al.
2008/0155831 A1 7/2008 Royle
2008/0189964 A1 8/2008 Bozikis et al.
2008/0196251 A1 8/2008 Royle
2009/0000126 A1 1/2009 Kraus
2009/0038167 A1 2/2009 Peyser et al.
2011/0016724 A1 1/2011 Murgida
2011/0088269 A1 4/2011 Walker, Jr. et al.
2011/0247217 A1 10/2011 Johnson et al.
2012/0210586 A1 8/2012 Lelieveld et al.
2012/0297625 A1 11/2012 Madden
2013/0081289 A1 4/2013 Wain et al.
2014/0109735 A1 4/2014 Shepperson
2014/0165800 A1 6/2014 Griffin et al.
2015/0158192 A1 6/2015 Tucker et al.
2015/0174776 A1 6/2015 Hawes
2015/0190936 A1 7/2015 Griffin et al.
2015/0290819 A1 10/2015 Giannopoulos et al.
2015/0306777 A1 10/2015 Georgakis et al.
2015/0314465 A1 11/2015 Giannopoulos et al.
2015/0314466 A1 11/2015 Papadopoulos-Papageorgis et al.
2015/0321366 A1 11/2015 Papadopoulos-Papageorgis et al.
2017/0036360 A1 2/2017 Griffin et al.
2017/0182672 A1 6/2017 Griffin et al.
2019/0263010 A1 * 8/2019 Griffin ..... B26B 21/4081

FOREIGN PATENT DOCUMENTS

EP 1488894 12/2004
EP 2123410 11/2009
GB 1460732 1/1977

(56) References Cited

FOREIGN PATENT DOCUMENTS

| | | |
|---|---|---|
| GB | 2030909 | 4/1980 |
| WO | 2006127435 | 11/2006 |
| WO | 2010022192 | 2/2010 |
| WO | 2012158143 | 11/2012 |
| WO | 2014051843 | 4/2014 |
| WO | 2014094909 | 6/2014 |

OTHER PUBLICATIONS

International Search Report/Written Opinion—PCT Application No. PCT/US2015/20538, dated Jun. 24, 2015, 8 pages.
Search Report—Corresponding European Application No. 13864593, dated Jul. 8, 2016, 7 pages.
Search Report—Corresponding European Patent Application No. 13840539, dated Apr. 25, 2016, 7 pages.

* cited by examiner

SHAVING SYSTEMS

RELATED APPLICATIONS

This application is a continuation application of U.S. patent application Ser. No. 15/455,507, which is a continuation application of U.S. patent application Ser. No. 14/661,048, filed Mar. 18, 2015, now U.S. Pat. No. 9,630,331, issued Apr. 25, 2017, which is a continuation application of PCT Application Serial No. PCT/US2013/052107, filed Jul. 25, 2013 which claims priority of U.S. Provisional Application Ser. No. 61/706,961, filed on Sep. 28, 2012. The complete disclosure of each of these applications is hereby incorporated by reference herein.

BACKGROUND

The invention relates to shaving systems having handles and replaceable blade units. Shaving systems often consist of a handle and a replaceable blade unit in which one or more blades are mounted in a plastic housing. After the blades in a blade unit have become dull from use, the blade unit is discarded, and replaced on the handle with a new blade unit. Such systems often include a pivoting attachment between the blade unit and handle, which includes a pusher and follower configured to provide resistance during shaving and return the blade unit to a "rest" position when it is not in contact with the user's skin.

SUMMARY

Embodiments of the present invention generally provide a reusable shaving system including a replaceable shaving assembly having a pivoting blade unit, and a reusable handle on which the shaving assembly is removeably mounted.

In one aspect, the invention features a replaceable shaving assembly that includes a blade unit; an interface element configured to removeably connect the blade unit to a handle, on which the blade unit is pivotably mounted; and a return element disposed on the interface element.

Some implementations include one or more of the following features.

The blade unit may be pivotably mounted on the interface element by the positioning of a pair of fingers, which extend from the interface element, in receiving bores or clips disposed on the blade unit. Pivoting of the blade unit is generally about an axis that is generally parallel to the long axis of the blade unit.

The return element may be formed of or include an elastomer, e.g., a thermoplastic elastomer or thermoplastic urethane.

The return element may be configured to interact with a corresponding structure on the blade unit, e.g., a clip disposed on the blade unit under which the return element is positioned, so as to provide a return force.

In some cases, the return element is in the form of two bands positioned adjacent to and inboard of the fingers, in which case the corresponding structure on the blade unit includes a pair of clips, under which the return elements are positioned. Alternatively, the return element may be in the form of a single band positioned generally centrally along the length of the interface element.

In some cases, the return element is supported and spaced from the main surface of the interface element by support elements that extend generally perpendicularly to a long axis of the interface element.

Preferably, the blade unit is mounted directly on the interface element, without any intervening structures that are not integral with the blade unit.

In another aspect, the invention features a shaving system that includes a handle having a distal end and a proximal end; and a replaceable shaving assembly that includes a blade unit, an interface element configured to removeably connect the blade unit to a handle, on which the blade unit is pivotably mounted, and a return element disposed on the interface element.

This shaving system may include any of the features disclosed above or elsewhere herein.

In yet a further aspect, the invention features a method of shaving comprising contacting the skin with the blade unit of a shaving system comprising a handle having a distal end and a proximal end, and a replaceable shaving assembly that includes a blade unit, an interface element configured to removeably connect the blade unit to a handle, on which the blade unit is pivotably mounted, and a return disposed on the interface element.

Advantageously, in some implementations the return element of the shaving systems disclosed herein eliminates the need for a "pusher/follower" razor construction to provide a force to supply resistance during shaving and return the blade unit to a "rest" portion when not in contact with the user's skin.

DETAILED DESCRIPTION

The present disclosure relates generally to consumer products and, in particular, to shaving systems with interchangeable blade units. In one embodiment, the present disclosure features a reusable consumer product system having an interchangeable pivoting blade unit, which includes an elastomeric return element. For example, the shaving systems disclosed herein include an interface element that provides a removable attachment between the handle and blade unit, and that includes one or more elongated elastomeric members that provide the resistance and return force usually supplied by a pusher/follower assembly.

Figure 1:
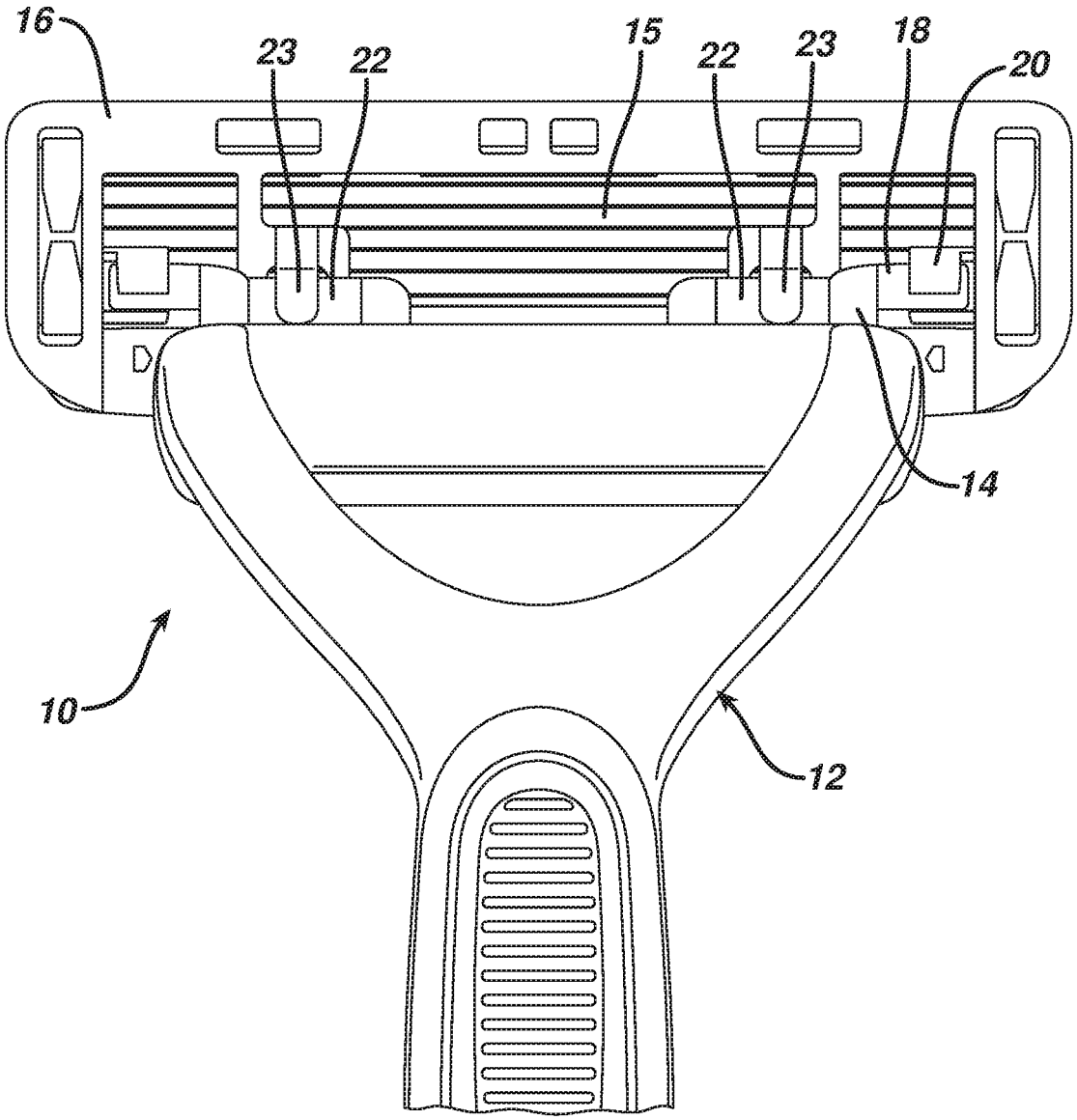
FIG. 1 is a rear plan view of a shaving system according to one embodiment of the invention.

FIG. 1 shows a shaving system 10 that includes a handle 12, interface element 14 (FIG. 2), and blade unit 16, which includes a plurality of blades 15. Blade unit 16 is pivotably mounted on interface element 14 by the positioning of a pair of fingers 18, which extend from the interface element, in receiving bores or clips 20 which may be molded integrally with the blade unit 16 or part of a separate connector snapped onto the blade unit. Pivoting of the blade unit is about an axis that is generally parallel to the long axis of the blade unit and is generally positioned to allow the blade unit to follow the contours of a user's skin during shaving.

Figure 14A:
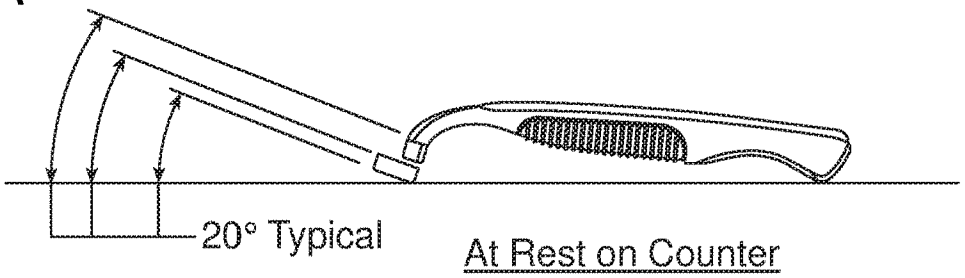
FIGS. 14A and B are diagrammatic views illustrating how the angle of the blade unit with respect to the handle at rest, and to the skin surface during shaving, is measured.
Figure 14B:
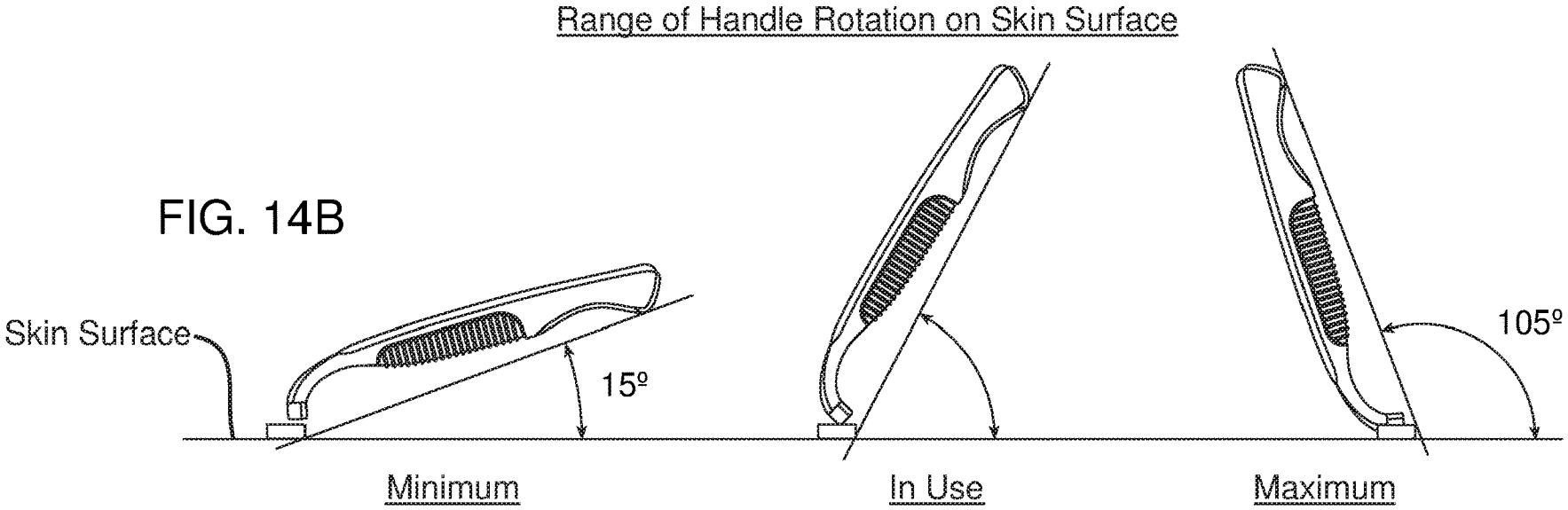

Referring to FIGS. 14A and 14B, the angle of blade unit 16 with respect to handle 12 is about 15° at rest, and the angle of the blade unit with respect to the skin surface can range from approximately 15° to 105° during shaving. The handle 12 provides a manner in which the shaving system can be manipulated and leverage can be applied to achieve desired shaving results.

Figure 2:
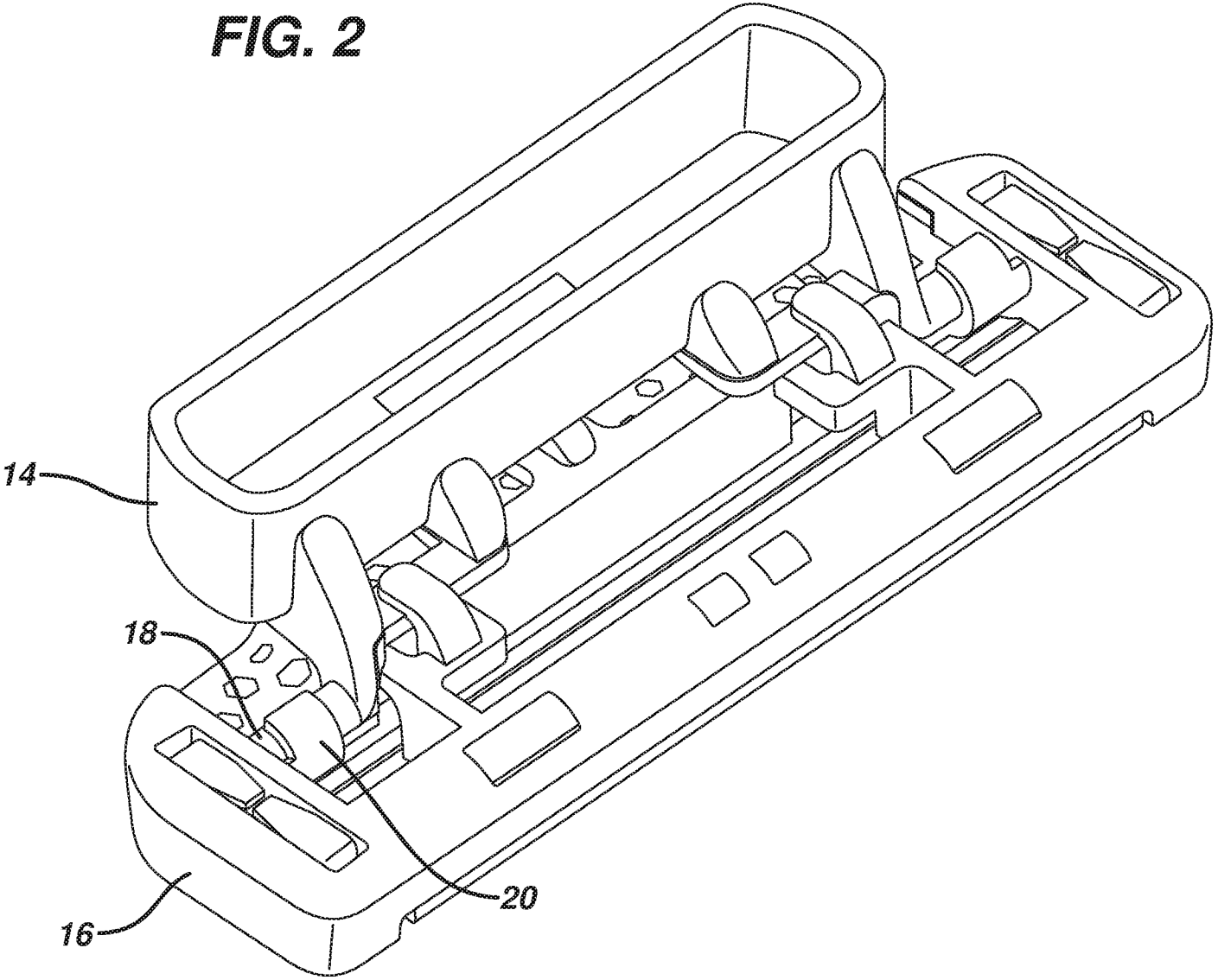
FIG. 2 is perspective view of the shaving assembly portion of the shaving system shown in FIG. 1.

Generally, the interface element 14 and blade unit 16 are sold to the consumer as an integrated replaceable shaving assembly. FIG. 2 shows the replaceable shaving assembly, including the blade unit and interface element, as it would be viewed when attaching the shaving assembly to a handle.

In this implementation, the return force is provided by a return element in the form of a pair of elongated resilient bands 22. Bands 22 are disposed on the interface element, inboard of the fingers 18, and are positioned to fit under a pair of clips 23 on the blade unit. The interaction of these bands with the clips 23 provides resistance during shaving, limiting the free pivoting of the blade unit about the pivot axis described above, and providing a return force that biases the blade unit towards its rest position, in the same manner that resistance and return are typically provided by a pusher/follower assembly.

The integration of the return element (bands 22) with the interface unit 14, and the relatively small profile of the fingers 18 and clips 20, provides a shaving assembly with very good rinsability. As shown in FIG. 1, almost the entire area behind the blades 15 is open, allowing debris to be readily rinsed out of the blade unit during use. For example, less than 20%, less than 10% or even less than 5% of the area behind the blades may be unobstructed in preferred embodiments.

Figure 3A:
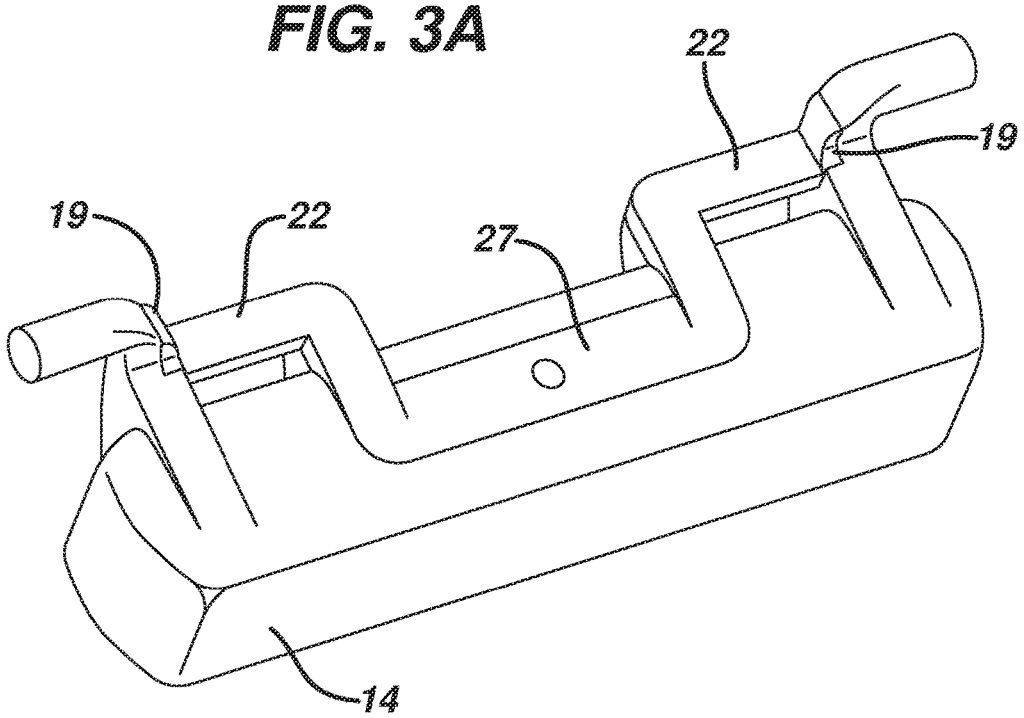
FIGS. 3A and 3B are perspective views from different directions of the interface element of the shaving assembly shown in FIG. 2.

Referring to FIG. 3A the two bands 22 can be integrally molded as part of a single elastomeric return element 27. This arrangement allows the return element to be molded via a central opening in the interface piece, and provides good anchoring of the elastomer on the interface element. Anchoring is also provided by side portions 19 of the bands 22, which are molded into corresponding underlying recesses (not shown) in the interface element.

Figure 3B:
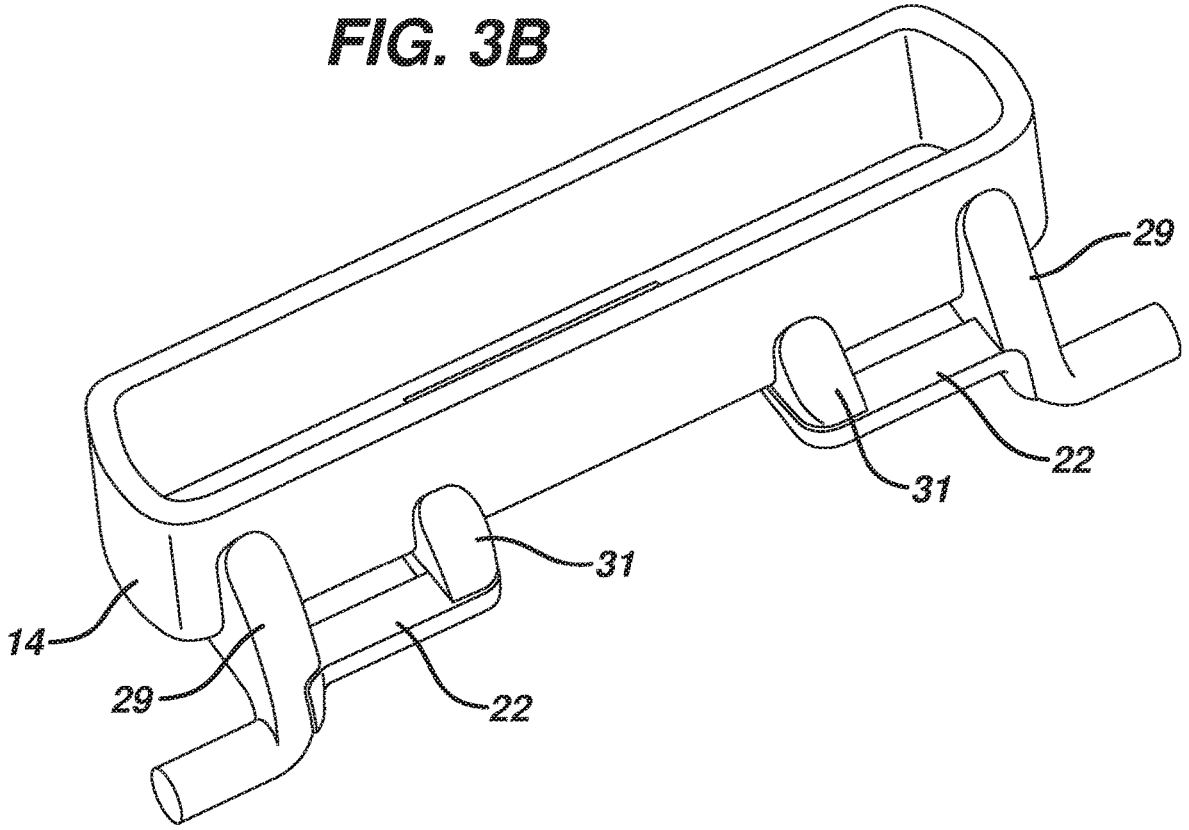

Referring to FIG. 3B, the bands 22 are each supported on the outboard side by an arm 29 from which the pin 18 extends and on the inboard side by a support 31. This support allows the bands 22 to effectively provide an opposing force to that of the clips 23, and prevents detachment of the bands 22 during the life of the product.

The return element can be formed, for example, from synthetic or natural rubber materials. Suitable materials include, for example, polyether-based thermoplastic elastomers (TPEs) available from Kraiburg HTP, thermoplastic urethanes (TPUs), silicones, and polyether-based thermoplastic vulcanizate elastomer (TPVs) available from GLS PolyOne Corporation under the tradename Santoprene™. The elastomeric material is selected to provide a desired degree of restoring force and durability. In some implementations, the elastomer has a Durometer of less than about 45 Shore A, e.g., from about 20 to 90 Shore A.

The bands 22 are pretensioned by a stretching of the bands that exists when the blade unit is in its at rest position. Pretensioning provides a resistance force so that a load is applied as soon as the user starts shaving, balancing the razor. The return element is generally designed such that its geometry provides an applied load as assembled that is sufficient to overcome the friction of the system at rest (pretensioned load), typically at least 5 grams, e.g., 5 to 15 grams, and a load during shaving of from about 5 to 100 grams, e.g., 10 to 50 grams.

Figure 4:
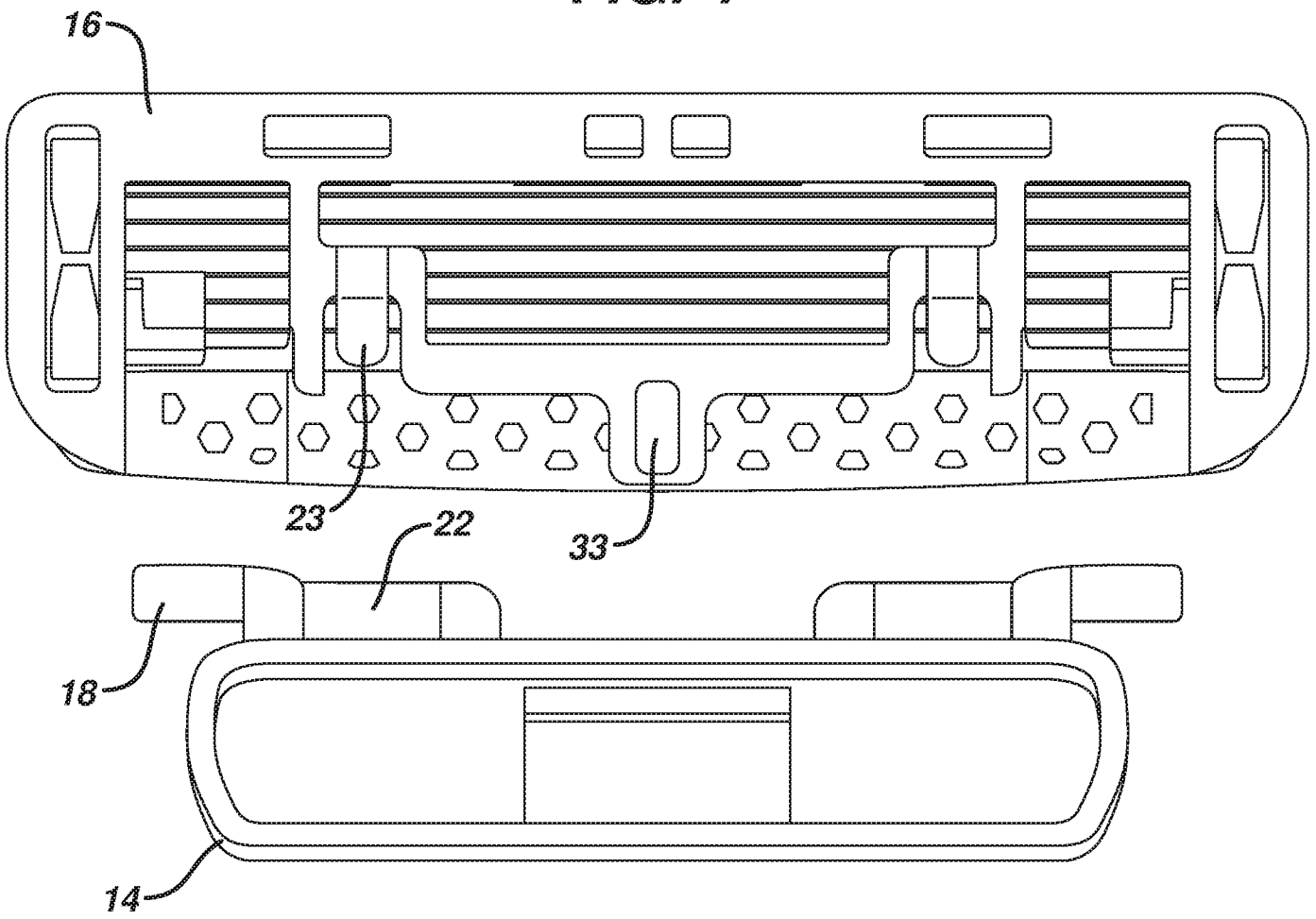
FIGS. 4, 5A and 5B are exploded views of the shaving assembly, showing the interface element separated from the blade unit.
Figure 5A:
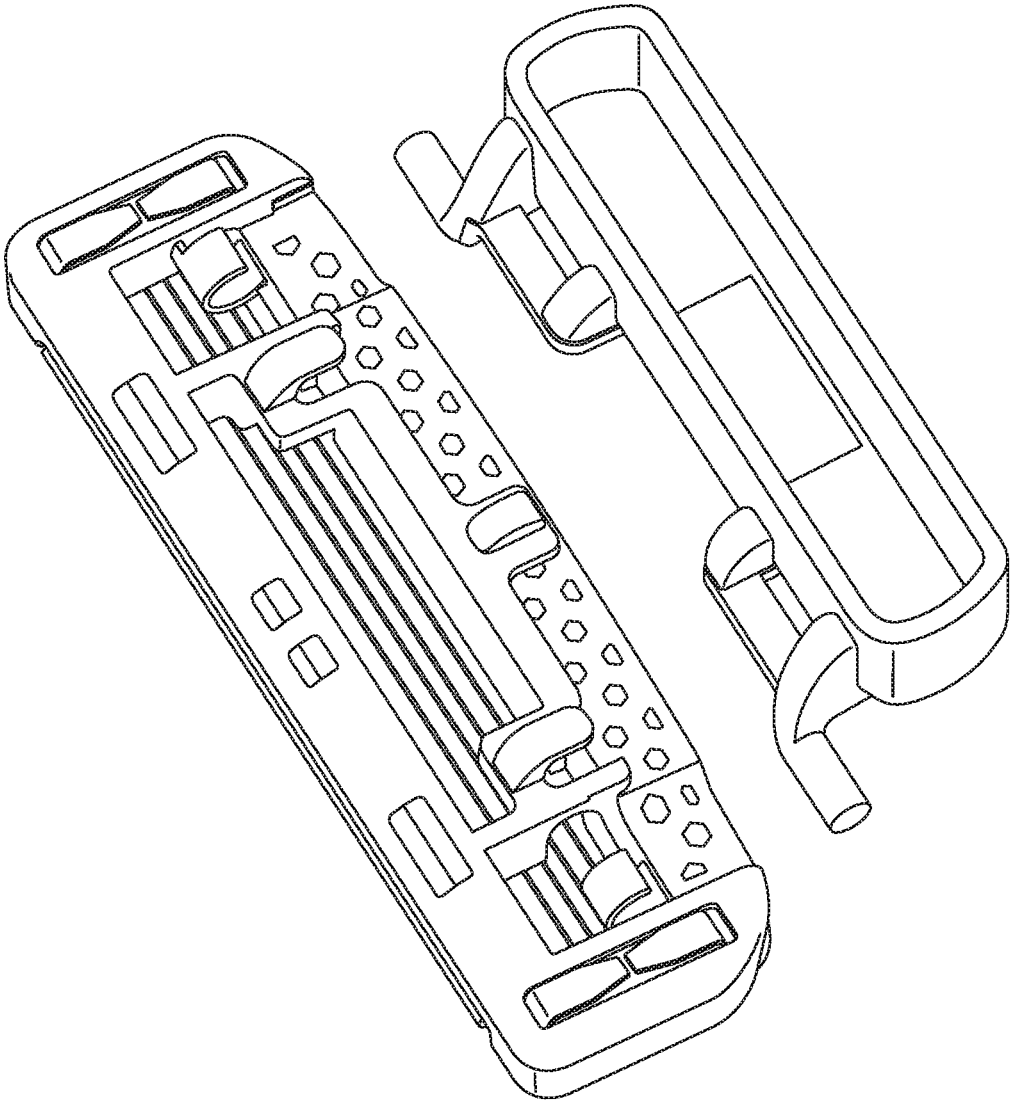
Figure 5B:
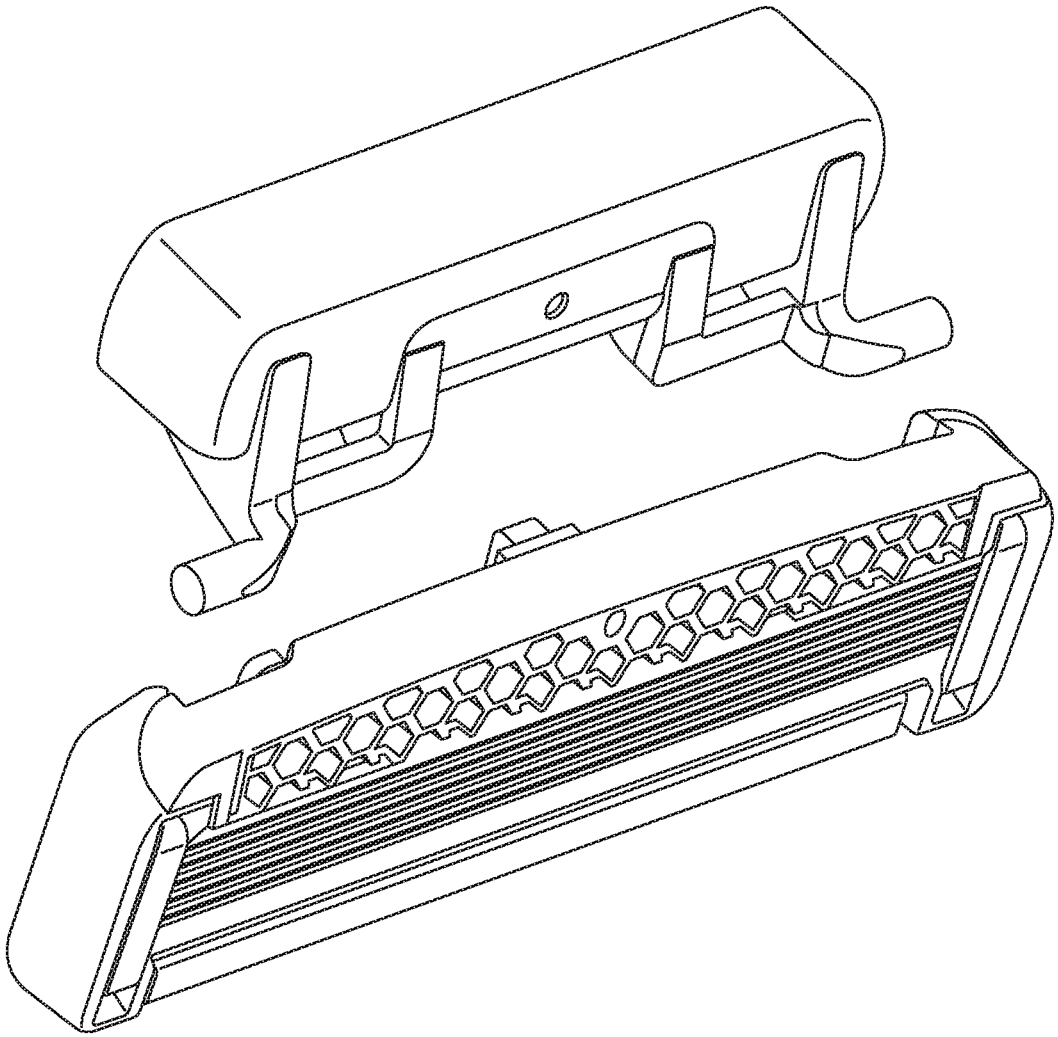
Figure 6:
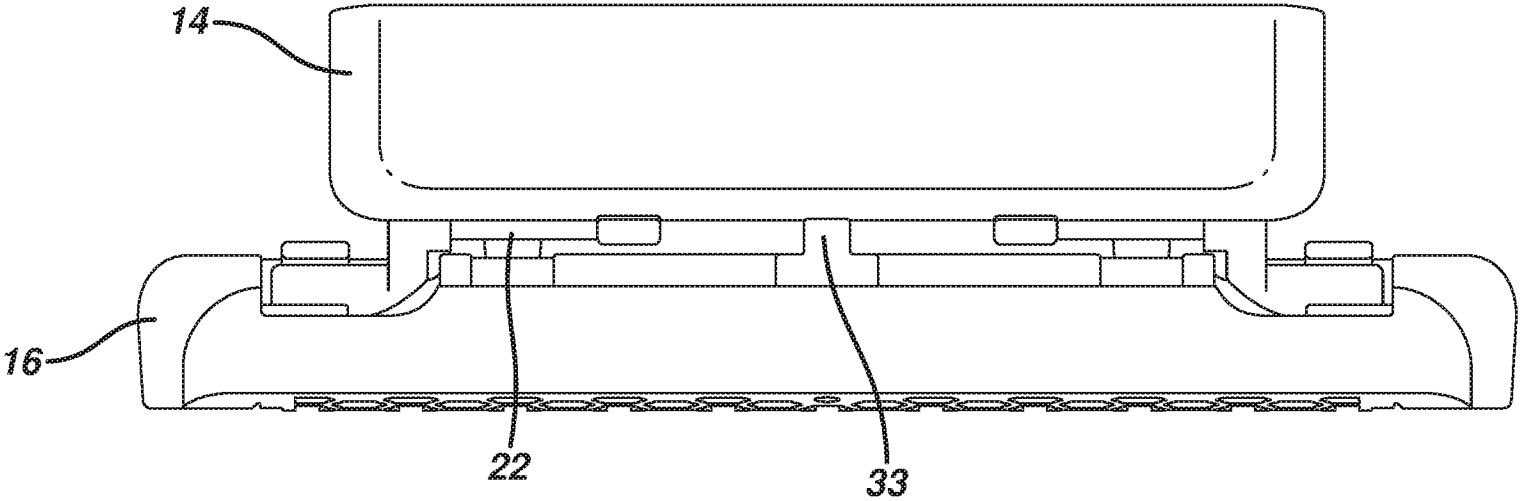
FIG. 6 is a rear elevational view of the shaving assembly of FIG. 2.
Figure 7:
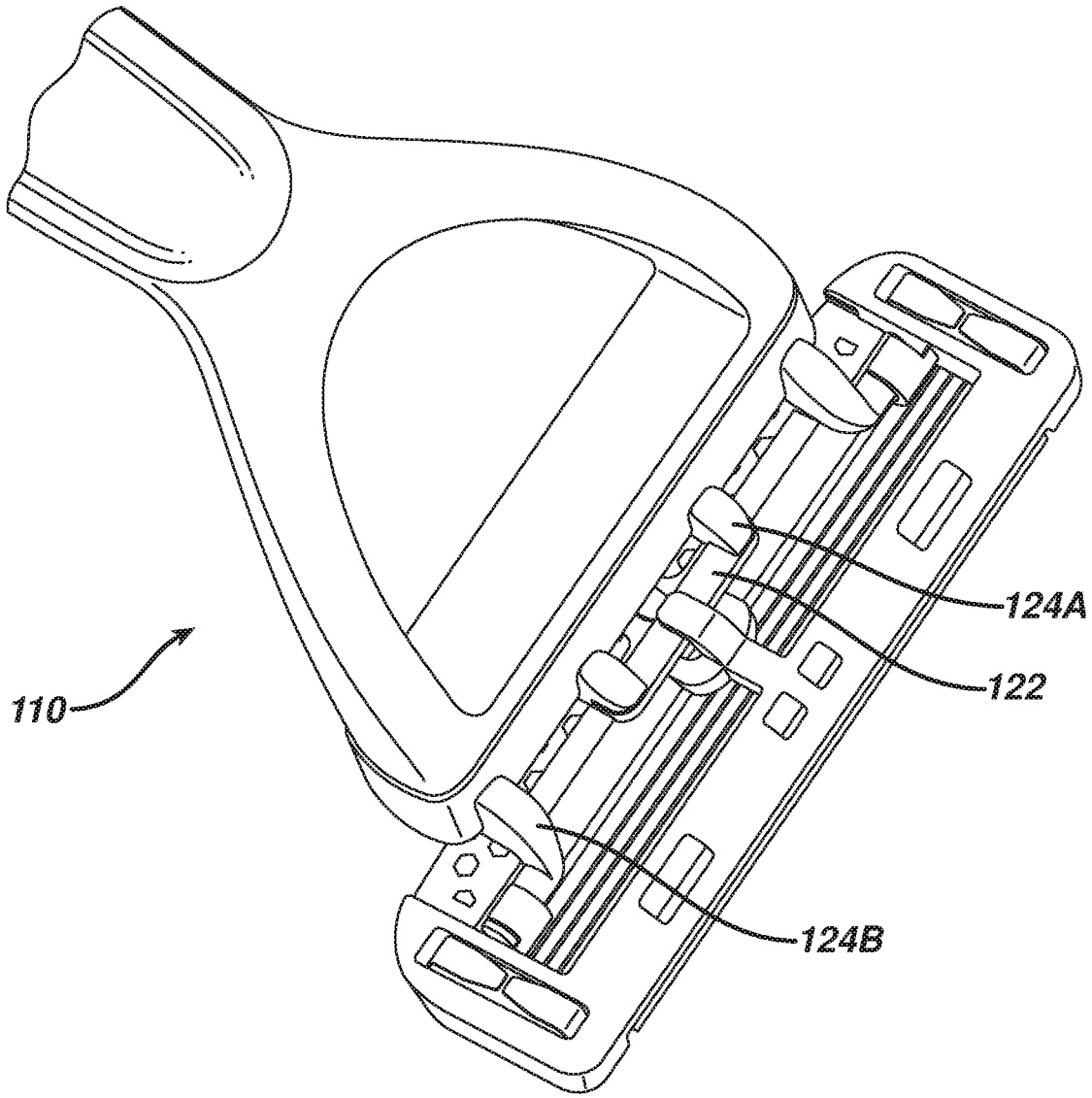
FIG. 7 is a perspective view of a shaving system according to an alternative embodiment.
Figure 8:
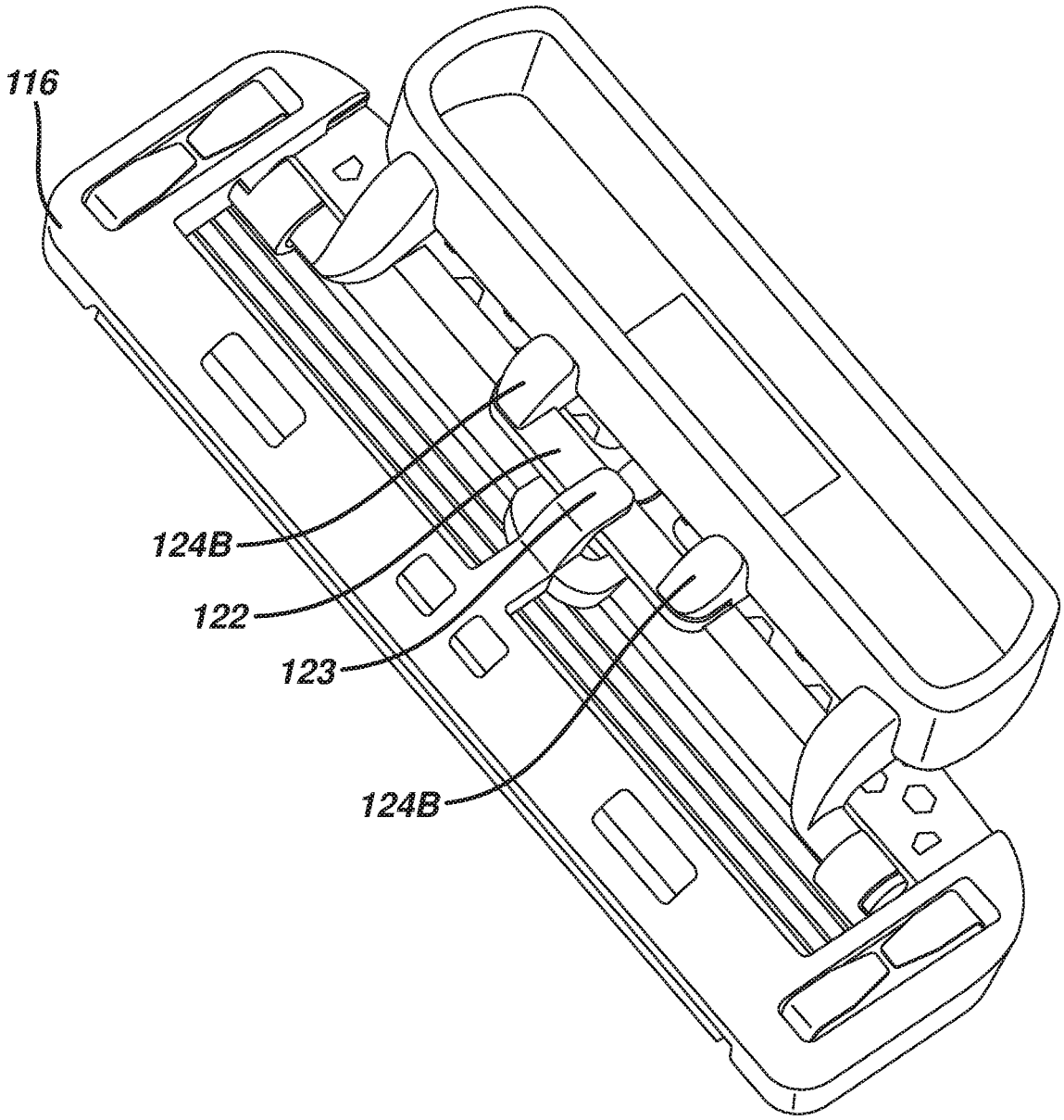
FIG. 8 is a perspective view of the shaving assembly portion of the shaving system shown in FIG. 7.
Figure 9A:
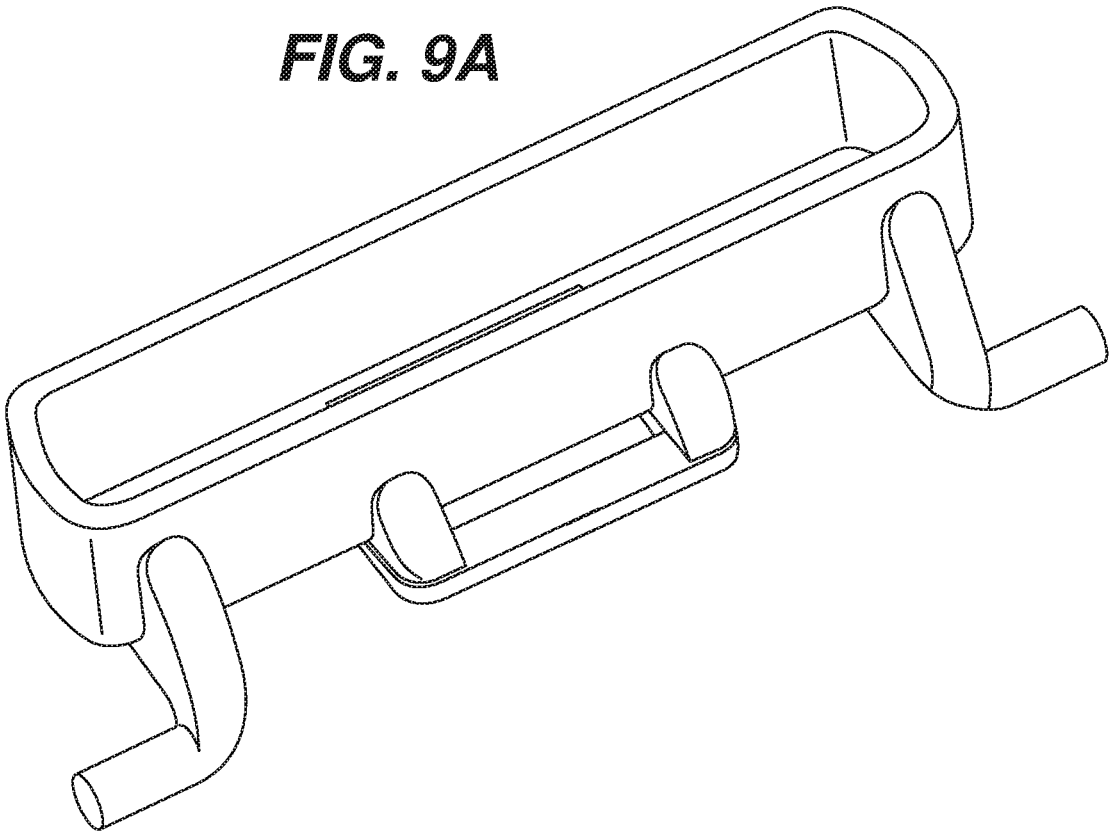
FIGS. 9A and 9B are perspective views from different directions of the interface element of the shaving assembly shown in FIG. 8.
Figure 9B:
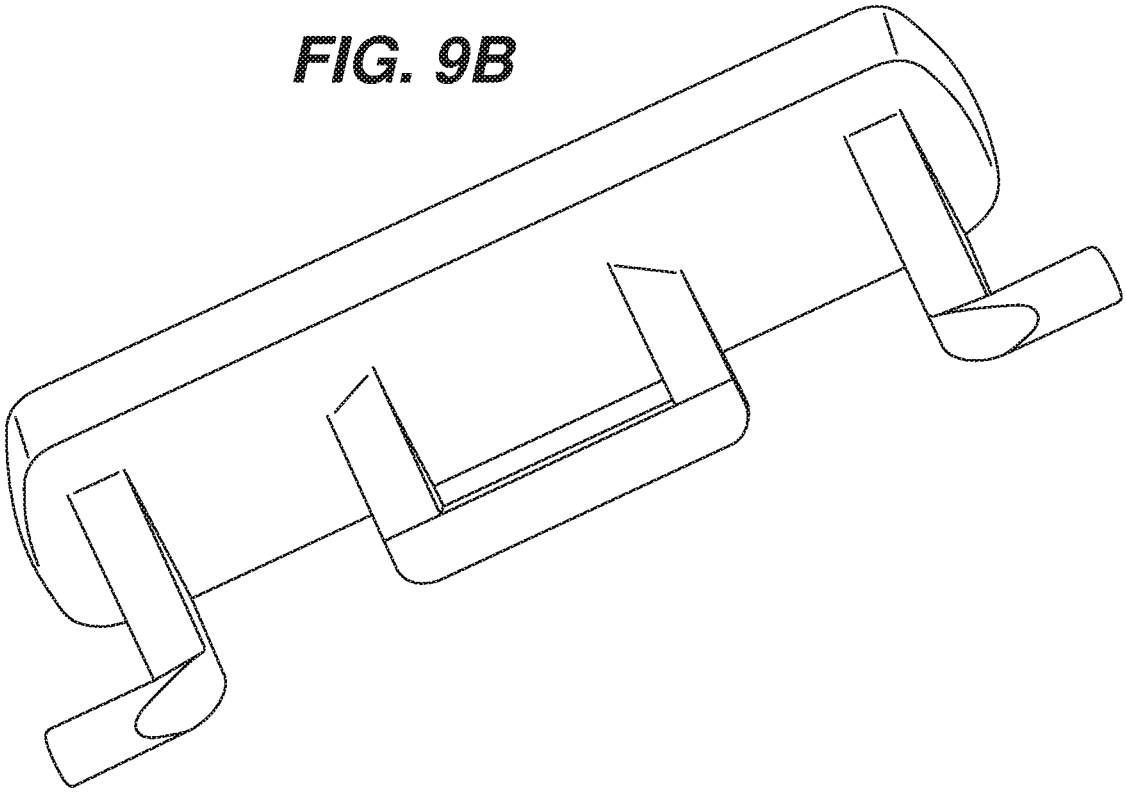

Exploded views of the shaving system are shown in FIGS. 4-5B, illustrating the manner in which the interface element and blade unit are aligned for assembly into a completed shaving assembly. FIGS. 4 and 6 also show pivot stop 33 on the blade unit, which is integrally formed with the blade unit and which limits the pivoting of the blade unit.

Figure 10:
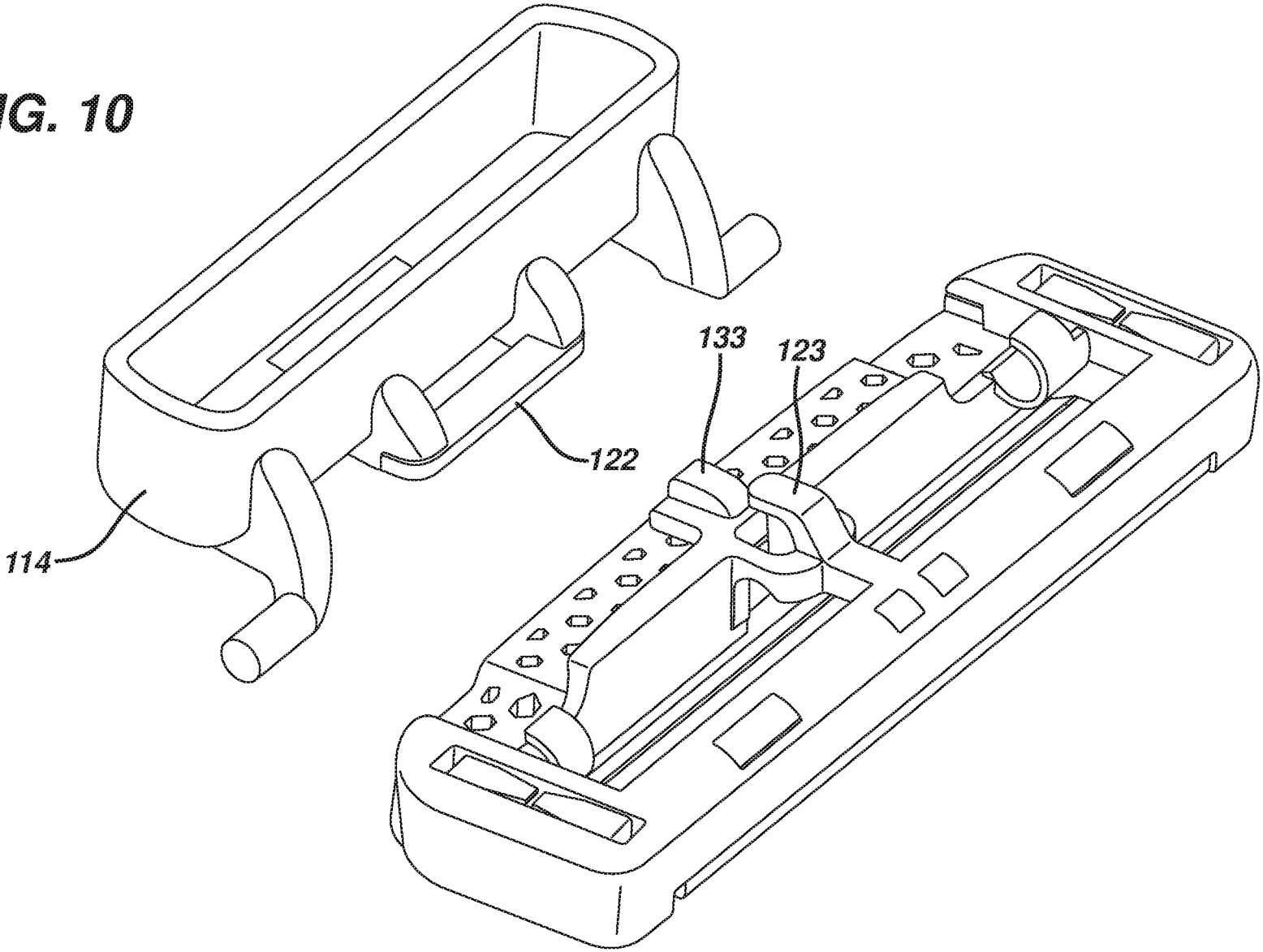
FIGS. 10-12 are exploded views of the shaving assembly, showing the interface element separated from the blade unit.
Figure 11:
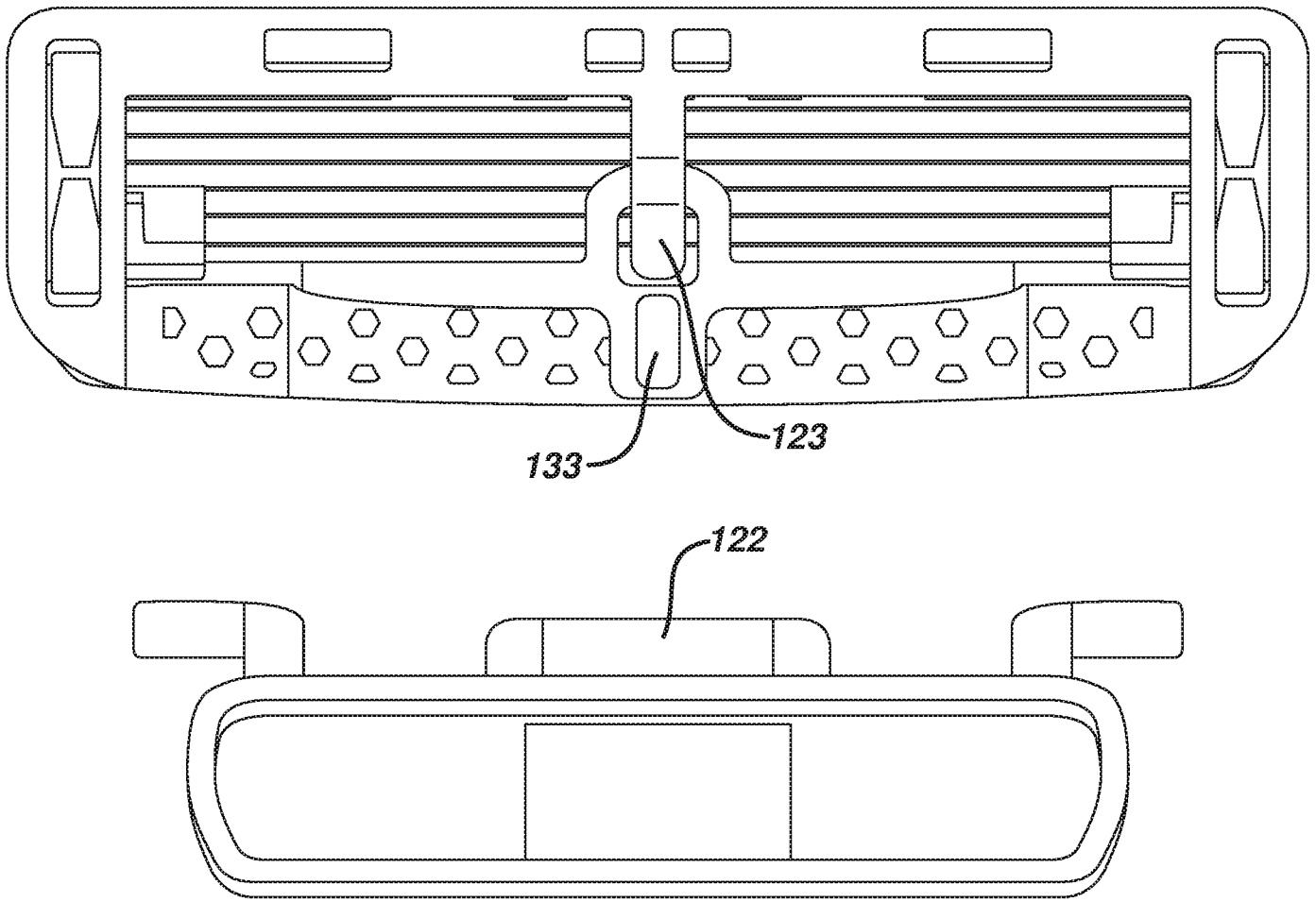
Figure 12:
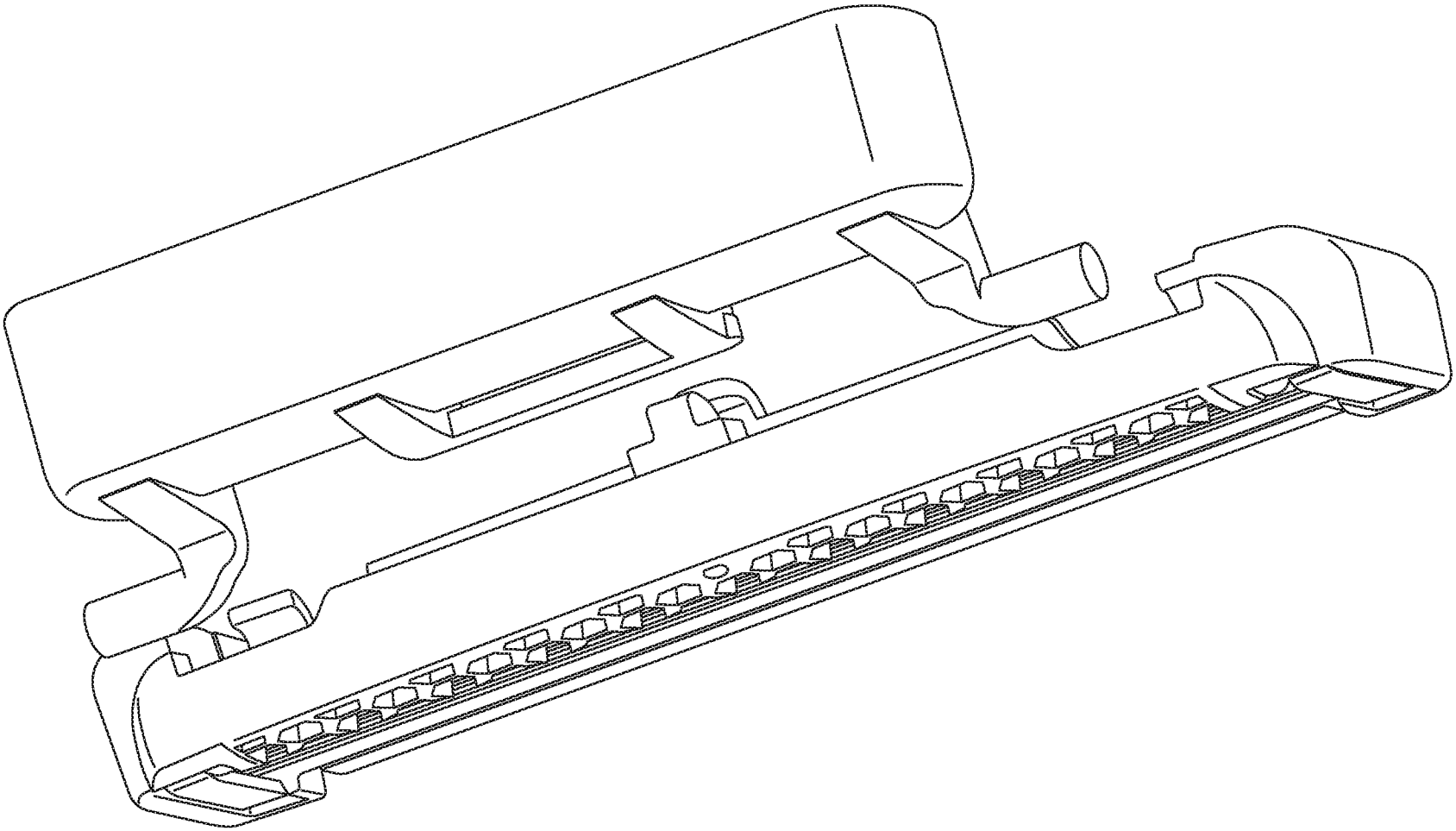
Figure 13:
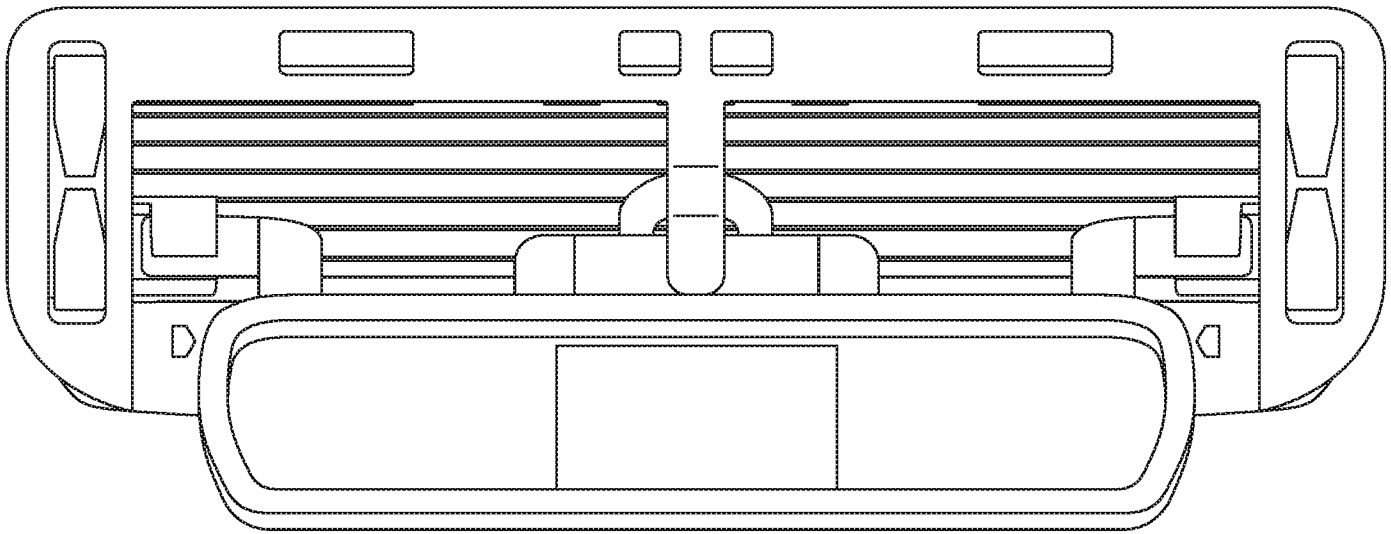
FIG. 13 is a rear plan view of the shaving assembly shown in FIG. 8.

FIGS. 7-13 show a shaving system 110 according to an alternate embodiment. This embodiment is similar to the one discussed above, except that instead of two return elements 22, the interface element includes a single return element 122. Return element 122 is mounted generally centrally along the length of the interface unit, and is supported by and spaced from the surface of the interface unit by a pair of support members 124A, 124B. In this case, the blade unit 116 includes a single, central clip 123, which engages the return element 122 in the same manner that clips 23 engage return elements 22 in the embodiment discussed above. Central clip 123 is positioned adjacent to pivot stop 133, as shown in FIGS. 10 and 11.

A number of embodiments have been described. Nevertheless, it will be understood that various modifications may be made without departing from the spirit and scope of the disclosure.

For example, in some implementations the shaving assembly could include three or more return elements and corresponding clips, for example the interface element could include both a central return element and a pair of return elements positioned adjacent the fingers.

Moreover, instead of being positioned over bands 22, as shown, clips 23 can be positioned in other manners relative to the bands, e.g., may extend through the bands.

As a further example, the pivoting mechanism may be different. For example, the fingers may be replaced by other types of protrusions, such as spherical members, or the entire pivoting mechanism may be replaced by a different type of pivot. Also, the pivoting mechanism may be positioned differently with respect to the bands or other return elements, e.g., in the embodiment shown in FIG. 1 the fingers could be moved inboard of the bands, and could face towards each other, and the clips or bores engaged by the fingers relocated correspondingly.

Accordingly, other embodiments are within the scope of the following claims.

What is claimed is:

1. A replaceable shaving assembly comprising:

a blade unit;

an interface element configured to removeably connect the blade unit to a handle, on which the blade unit is pivotably mounted; and an elastomeric return element disposed on the interface element and in the form of a single band positioned generally centrally along the length of the interface element;

wherein the return element is configured to interact with a clip that is generally centrally located along a longitudinal axis of the blade unit, under which the return element is positioned, so as to provide a return force.

2. The shaving assembly of claim 1 wherein the blade unit is pivotably mounted on the interface element by the positioning of a pair of fingers, which extend from the interface element, in receiving bores or clips disposed on the blade unit.

3. The shaving assembly of claim 1 wherein pivoting of the blade unit is about a longitudinal axis that is generally parallel to the longitudinal axis of the blade unit.

4. The shaving assembly of claim 1 wherein the blade unit includes a pivot stop and the clip is disposed adjacent to the pivot stop.

5. The shaving assembly of claim 1 wherein the return element has a longitudinal axis extending generally parallel to the longitudinal axis of the blade unit.

6. The shaving assembly of claim 5 wherein the return element is supported and spaced from the interface element by support elements that extend generally perpendicularly to a longitudinal axis of the interface element.

7. The shaving assembly of claim 1 wherein the blade unit is mounted directly on the interface element.

8. A shaving system comprising:

a handle having a distal end and a proximal end; and mounted on the handle, a replaceable shaving assembly that includes a blade unit, an interface element configured to removeably connect the blade unit to the handle, on which the blade unit is pivotably mounted, and an elastomeric return element in the form of a single band positioned generally centrally along the length of the interface element;

wherein the return element is configured to interact with a clip that is generally centrally located along a longitudinal axis of the blade unit, under which the return element is positioned, so as to provide a return force.

9. The shaving system of claim 8 wherein the blade unit is pivotably mounted on the interface element by the positioning of a pair of fingers, which extend from the interface element, in receiving bores or clips disposed on the blade unit.

10. The shaving system of claim 8 wherein pivoting of the blade unit is about an axis that is generally parallel to the longitudinal axis of the blade unit.

11. The shaving system of claim 8 wherein the blade unit includes a pivot stop and the clip is disposed adjacent to the pivot stop.

12. The shaving system of claim 8 wherein the return element has a longitudinal axis extending generally parallel to the longitudinal axis of the blade unit.

13. The shaving system of claim 12 wherein the return element is supported and spaced from the interface element by support elements that extend generally perpendicularly to a longitudinal axis of the interface element.

14. The shaving system of claim 8 wherein the blade unit is mounted directly on the interface element.

15. A method of shaving comprising contacting a patient's skin with a blade unit of a shaving system comprising a handle having a distal end and a proximal end, and a replaceable shaving assembly, mounted on the distal end of the handle, that includes the blade unit, an interface element configured to removeably connect the blade unit to the handle, on which the blade unit is pivotably mounted, and an elastomeric return element in the form of a single band positioned generally centrally along the length of the interface element wherein the return element is configured to interact with a clip that is generally centrally located along a longitudinal axis of the blade unit, under which the return element is positioned, so as to provide a return force.

* * * * *